United States Patent [19]

Richards

[11] 3,956,551

[45] May 11, 1976

[54] DUST COLLECTION MATS

[75] Inventor: Ernest Levon Richards, LaGrange, Ga.

[73] Assignee: Deering Milliken Research Corporation, Spartanburg, S.C.

[22] Filed: Sept. 16, 1974

[21] Appl. No.: 506,352

[52] U.S. Cl. ..... 428/88; 428/95

[51] Int. Cl.[2] ..... D03D 27/00; D04H 11/00; D05C 17/00

[58] Field of Search ..... 161/62–67, 161/39, 61, 82, 84, 85, 89, 145, 149; 117/68; 428/85, 88, 95, 253

[56] References Cited

UNITED STATES PATENTS

| | | | |
|---|---|---|---|
| 2,184,970 | 12/1939 | Allen | 161/149 X |
| 3,227,574 | 1/1966 | Mohr | 161/67 X |
| 3,306,808 | 2/1967 | Thompson | 161/67 X |
| 3,400,039 | 9/1968 | Mason | 161/63 |

*Primary Examiner*—Marion E. McCamish
*Attorney, Agent, or Firm*—Earle R. Marden; H. William Petry

[57] ABSTRACT

A dust control mat having a pile fabric upper surface and a bottom calendered rubber stock sheet which employs an anti-tear strip located perpendicular to the grain or calendered direction of the rubber stock sheet between the rubber sheet and a latex backing on the pile fabric. A novel method is employed to produce the mat in which the reinforcing tear strip is located in position prior to vulcanizing the rubber stock sheet in an autoclave.

2 Claims, 6 Drawing Figures

DUST COLLECTION MATS

The production and usage of dust control mats, using calendered rubber stock as a backing, has grown vigorously since introduction in 1969. This mat has gained acceptance because of its inherent safety attributed to the excellent skid resistance and high density of the calendered rubber stock, i.e., the mat cannot be blown over by the wind or easily displaced by someone kicking the mat. Conversely, this type mat has an inherent shortcoming that reduces the average rental service life of the mat. Because calendered sheet rubber stock has a tendency to tear in the calendered direction, many mats are prematurely torn in the cleaning/drying process by industrial laundries. Such tearing can be minimized by tufting the pile into woven fabrics that have high tear strengths; however, use of such fabrics is expensive and makes the mat too costly to compete in the current market. A latex backed mat having a woven fabric base as described in U.S. Pat. No. 3,306,808 would be less expensive but does not have the weight and safety features of a mat backed with sheet rubber stock. In order to keep down the cost of producing the subject mat one usually tufts into a non-woven fabric such as Synvar, a polyester non-woven, that has sufficient strength and fabric density to hold the pile yarn and to permit precoating of the mat with a latex to promote laminar adhesion between the fabric member and the calendered rubber stock.

Therefore, it is an object of the invention to provide a method to produce a dust control mat which has a tear-resistant strip located therein in a direction substantially perpendicular to the grain of the calendered rubber stock backing.

Other objects of the invention will become clearly apparent as the specification proceeds to describe the invention with reference to the accompanying drawings, in which.

Figure 1:
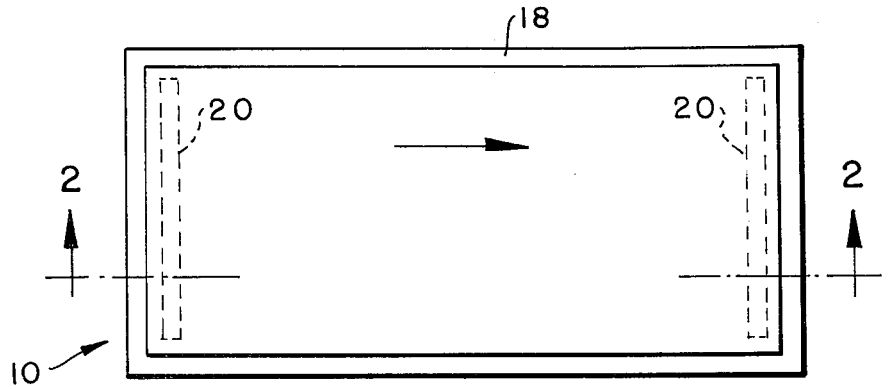
FIG. 1 is a schematic top view of the new and novel dust control mat.
Figure 2:
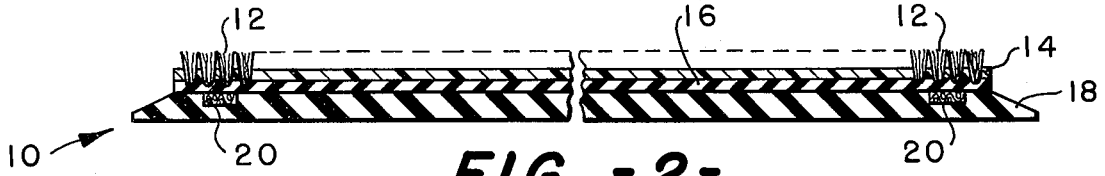
FIG. 2 is a section view taken on line 2—2 of FIG. 1.

FIGS. 1 and 2 show views of the improved dust control mat 10 which comprises tufts of yarn 12 tufted into a non-woven fabric 14 and held therein by a tie-coat 16 of suitable latex material such as Neoprene. Laminated to the bottom of the tie-coat 16 is a cured, calendered rubber backing sheet 18. To prevent and lessen the tendency of the mat 10, and in particular the rubber backing sheet 18, from tearing a narrow elongated anti-tear strip 20 is located between the tie-coat 16 and the rubber backing sheet 18 in a direction substantially perpendicular to the grain of the rubber backing sheet 18.

Generally, to produce the mat, the pile yarns of the subject mat are tufted into a non-woven fabric capable of withstanding the forces of tufting and subsequently holding the yarns in place as the pile fabric is precoated with a tie coat, for example, chloroprene latex such as duPont's Neoprene, and dried. (The functions of the precoat are to bind the fibers of the backstitch together and to promote laminar adhesion of the fabric component with a calendered rubber backing.) After precoating, the fabric is cut to desired size and shape and placed in a mold where uncured calendered rubber stock is placed on top of the pre-coated back of the mat. Thereafter, a vacuum is created under the rubber to produce intimate contact with the pre-coated side of the textile component. This vacuum also prevents water vapors from remaining in or entering the assembly during subsequent curing of the rubber which would reduce the development of laminar adhesion between the rubber and the pre-coated textile. After the vacuum has been established, the assembly is placed in an autocalve where superheated steam is maintained at a pressure of about 70 PSIG for about 20–27 minutes to cure the rubber. Thereafter, the stream in the autoclave is released, the autoclave door is opened, the vacuum is released and the mats are removed, cooled and the rubber edges are trimmed to produce a border around each mat.

Figure 3:
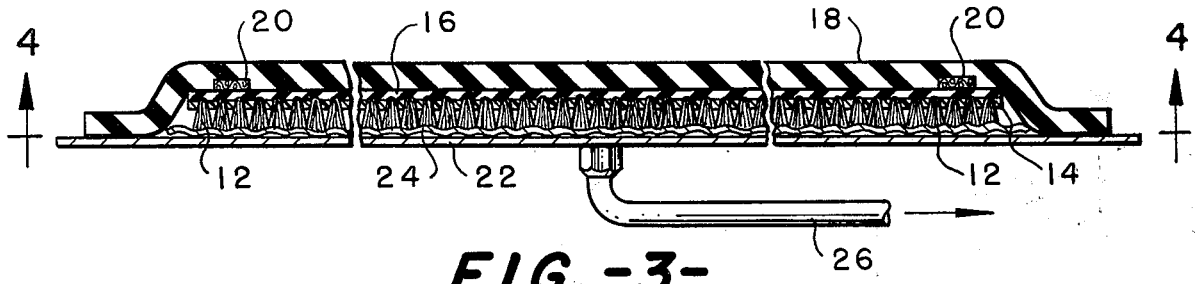
FIG. 3 is a cross-section of the pre-coated, pre-cut mat fabric located in a platen or vacuum mold and covered with a sheet of rubber stock when a vacuum has been applied.
Figure 4:
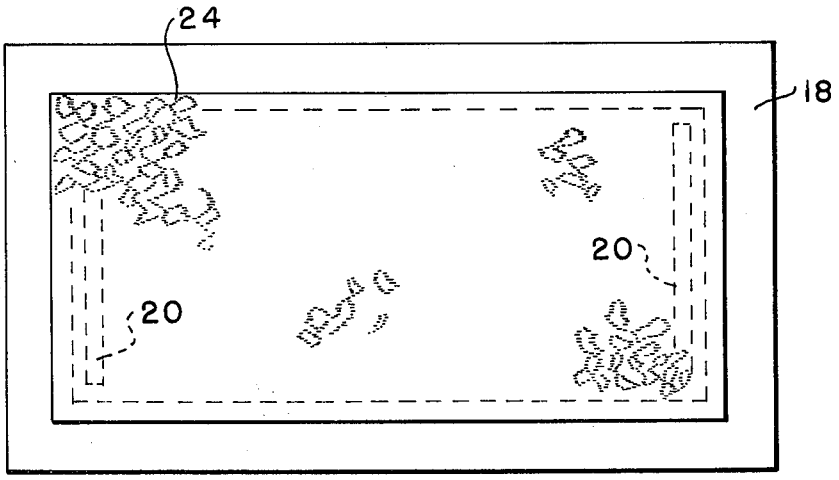
FIG. 4 is a bottom view of FIG. 3 taken on line 4—4 of FIG. 3.
Figure 5:
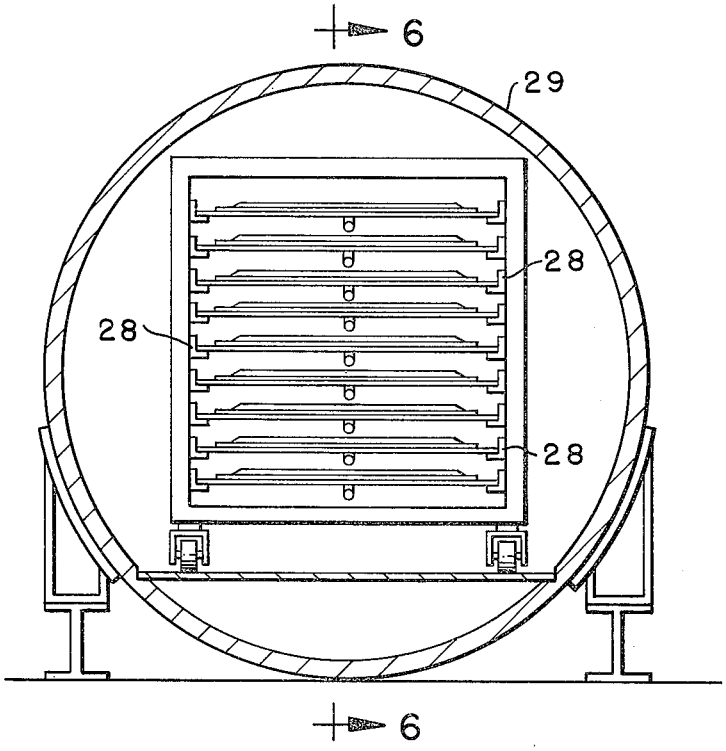
FIG. 5 is a cross-section view of an autoclave with a plurality of vacuum molds located therein and FIG. 6 is a cross-section view taken on line 6—6 of FIG. 5.
Figure 6:
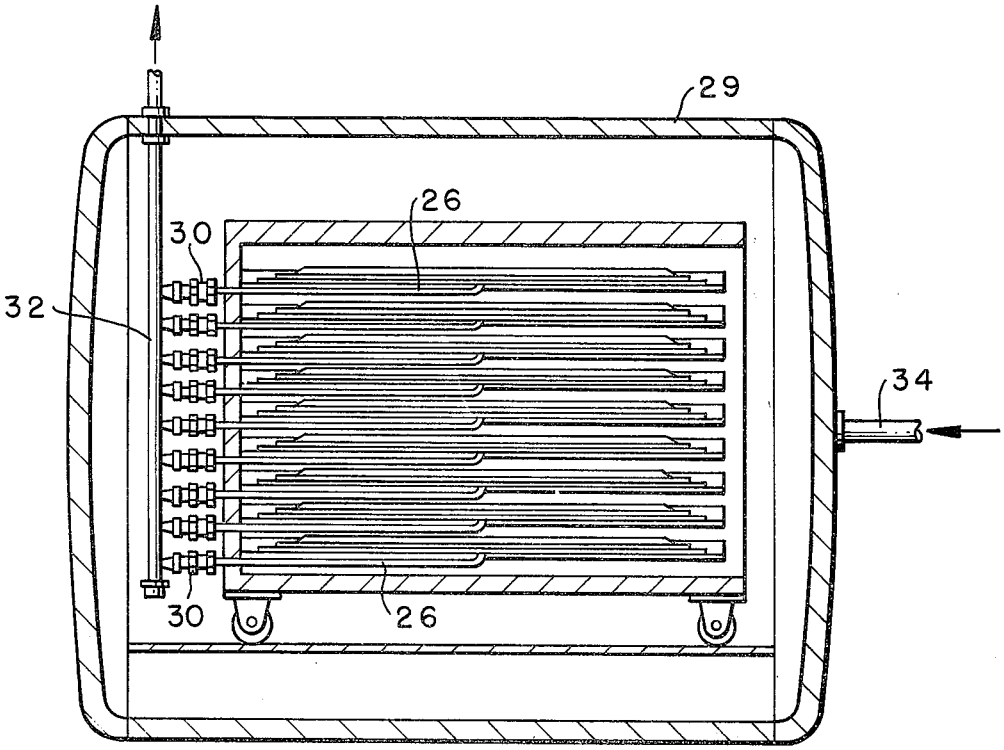

Now looking at the invention in detail the pre-coated and pre-cut fabric, consisting of tufts 12, non-woven fabric 14 and tie-coat 16, is centered on a vacuum mold consisting of plate 22 and non-uniform undulated plate 24 as shown in FIG. 3. Then a sheet of calendered rubber stock 18 of predetermined width and length is placed on the above mentioned fabric. Then, preferably the ends of the rubber sheet 18 are laid back to expose the leading edges of the tie-coat 16 and the anti-tear strips 20 are then placed in position substantially perpendicular to the calendered direction of the rubber sheet. If desired, the anti-tear strips 20 can be placed on the tie-coat 16 prior to placing of the rubber sheet 18, but it is preferred to place the rubber sheet 18 first to get it correctly placed. Then the leading edges of the rubber sheet are replaced so that when a vacuum is sucked thru conduit 26 the rubber sheet 18 will assume the shape shown in FIG. 3 to seal the mold. Then a plurality of loaded molds are placed on brackets 28 into the autoclave 29 (FIGS. 5 and 6) with the suction connections 30 connected to the suction manifold 32. Then a suction pressure is applied to the suction manifold 32 to evacuate the molds and pull the rubber sheets 18 down into sealing relationship with the plates 22. Then, while the vacuum is maintained in the molds, the door 35 to the autoclave 29 is closed, and steam at a pressure of about 70 PSIG is injected through conduit 34 into the autoclave 29 and the autoclave is maintained at such steam pressure for about 20–27 minutes until the rubber sheet 18 is cured. Thereafter, the steam is released, the autoclave opened, the vacuum pressure released and the mats are removed from the mold. Then the mats are cooled and trimmed to produce the product shown in FIGS. 1 and 2.

Preferably the anti-tear strip is of such length that its ends do not protrude from under the mat fabric edges. The width of the anti-tear strip is governed by the physical characteristics and cost of the fabric used, however, a width of about 1.5 inch is preferred. Narrower widths may be used; however, as the width decreases the ease of keeping the tear strip in position while the rubber sheet 18 is positioned to proper placement is generally reduced. For instance, even cords, such as nylon, cotton, polyester, etc., can be used as anti-tear strips. Cords are not as effective as the preferred fabric due to the tendency of tears in calendered rubber to "jump" a cord and tear further.

In order to promote adhesion of the anti-tear strip to the rubber sheet and the mat fabric, two avenues are available (1) the anti-tear fabric may be woven or knitted, or punched with interstices or openings of such size to allow the calendered rubber stock to flow therethru to produce intimate contact and subsequent adhesion with the precoat of the mat fabric, (2) the anti-tear fabric may be more closely woven or knitted and coated with resorcinal-formaldehyde/latex, or other tie coats known to the art, to produce the necessary adhesion. For example, a bulked, crimped nylon yarn fabric has been coated with tie coats, known to the art, and successfully used as an anti-tear strip across the leading edge of the mat. In alternative (1) it is to be understood that these fabrics can also be precoated with said tie coats. Additionally, non-woven fabrics will perform as anti-tear strips provided their strengths are sufficient to inhibit the rubber from tearing past such anti-tear strips.

The dimensional stability characteristics of the primary backing fabric, rubber backing, and anti-tear reinforcement of sheet rubber backed mats must be so similar in nature that significant differential elongation and/or shrinkage will not develop between either during usage or cleaning; because, such differentials produce undesirable distortions, e.g., rippling of the borders, of this type mat. Obviously, the choice of the reinforcement elements in a mat is therefore predicated on mutual compatibility with the other components of the mat as well as the general performance characteristics of the anti-tear material.

It has been determined that dust control oils applied to mats when processed in the laundry and/or forces encountered in end-use traffic can cause rubber backings of mats to "grow" or swell. If an anti-tear strip allowing no elongation is used in mats that "grow", ripples in the rubber border of the mat beyond the anti-tear strip can develop because of the fixed dimension of the mat covering the anti-tear strip. Some mats, especially if washed at high temperatures, may shrink. This is particularly true if the mats are not treated with dust control treatment oils that normally cause some swelling of rubber that would partially offset the shrinkage. Therefore, to be satisfactory in such mats, reinforcement strips must be reliably resilient while allowing reasonable compensating contraction.

To overcome the problems of shrinkage or growth, it has been found that suitably resilient fabrics woven of crimped yarns, or knitted fabrics, can contract or elongate with rubber backed mats as they shrink or grow thereby effectively preventing adverse distortions in these mats.

Preferably the dimensional stability characteristics of anti-tear strips for mats should correlate with the dimensional stability characteristics of the finished mat such that (1) the strips will not cause noticeable distortion of the mat, and (2) the strips will restrain undue stretching of the mat thereby preventing tearing of the mat. Most desirably, anti-tear strips should undergo nominal change to equate the stretch or shrinkage of the mat in which they are laminated. Stretching of anti-tear strips must obviously be restricted below such limits that would result in tearing of the mat.

It can be seen that a method of producing dust control mats has been disclosed which prevents tearing of the rubber backing material in the calendered direction and at the same time prevents rippling of the mat. Further, the produced dust control mat is not only economical to produce but has a much longer service life.

Although the preferred embodiments of the invention have been described, it is contemplated that changes may be made without departing from the scope or spirit of the invention and it is described that the invention be limited only by the scope of the claims.

That which is claimed is:

1. A dust control mat comprising: a sheet of textile material, a plurality of tufts of yarn connected thereto, a latex material coated to said sheet material holding said yarn tufts in said sheet material, a calendered rubber sheet laminated to said latex material and a narrow, resilient, knit reinforcing strip located between said latex material and said calendered rubber sheet with the elongated dimension being substantially perpendicular to the grain direction of said calendered rubber material, said reinforcing strip being shorter than the calendered rubber sheet and said sheet material in the length of the mat perpendicular to the grain direction of the calendered rubber sheet and being located adjacent one edge of said calendered rubber sheet.

2. The mat of claim 1 wherein a second, knit, elongated reinforcing strip is located between said latex material and said calendered rubber sheet adjacent a second edge of said calendered rubber sheet with the elongated dimension thereof substantially perpendicular to said calendered rubber sheet.

* * * * *